US009583821B2

(12) United States Patent
Hill et al.

(10) Patent No.: US 9,583,821 B2
(45) Date of Patent: Feb. 28, 2017

(54) ANTENNA RELATED FEATURES OF A MOBILE PHONE OR COMPUTING DEVICE

(71) Applicant: Apple Inc., Cupertino, CA (US)

(72) Inventors: Matthew D. Hill, Santa Clara, CA (US); Scott A. Myers, Saratoga, CA (US); Jared M. Kole, San Francisco, CA (US); Liane J. Fang, Los Altos, CA (US); Benjamin J. Pope, Sunnyvale, CA (US); Daniel W. Jarvis, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 242 days.

(21) Appl. No.: 14/253,779

(22) Filed: Apr. 15, 2014

(65) Prior Publication Data

US 2015/0061941 A1 Mar. 5, 2015

Related U.S. Application Data

(60) Provisional application No. 61/873,540, filed on Sep. 4, 2013.

(51) Int. Cl.

| | |
|---|---|
| ***H01Q 1/38*** | (2006.01) |
| ***H01Q 1/24*** | (2006.01) |
| ***H01Q 9/14*** | (2006.01) |
| *H01Q 1/22* | (2006.01) |

(52) U.S. Cl.

CPC ..... *H01Q 1/38* (2013.01); *H01Q 1/2291* (2013.01); *H01Q 1/243* (2013.01); *H01Q 9/14* (2013.01); *H01Q 1/2258* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 6,633,260 | B2 | 10/2003 | Paschen et al. | |
| 6,861,990 | B2 | 3/2005 | Hung et al. | |
| 6,940,459 | B2 | 9/2005 | Sullivan et al. | |
| 7,170,466 | B2 | 1/2007 | Janoschka | |
| 7,248,220 | B2 * | 7/2007 | Futamata | H01Q 5/378 343/700 MS |
| 7,830,331 | B2 | 11/2010 | Yamazaki et al. | |
| 2010/0060529 | A1 * | 3/2010 | Schlub | H01Q 1/243 343/702 |
| 2010/0103058 | A1 * | 4/2010 | Kato | G06K 19/07749 343/702 |

* cited by examiner

*Primary Examiner* — Hoang V Nguyen
*Assistant Examiner* — Hai Tran

(57) ABSTRACT

Antenna related features of a mobile phone or computing device are disclosed. In one embodiment, wireless control and signal are fed separately through difference types of flexes to optimize performance and cost. In one embodiment, active switching and processing of differing conductive trace lengths are performed on an antenna flex so that antenna performance can be optimized for multiple wireless technologies covering a wide range of wavelengths. In one embodiment, a cantilever arm affixed to a ground screw can provide double grounding in a region with no available screw points due to high z constraint. In one embodiment, a device can provide double feed for antenna through a single screw. In one embodiment, a short pin can be configured to support thinner metal. In one embodiment, a "vibrator bracket/LDS short pin" structure can be used to share a common screw point.

20 Claims, 17 Drawing Sheets

ANTENNA RELATED FEATURES OF A MOBILE PHONE OR COMPUTING DEVICE

CROSS-REFERENCE TO RELATED APPLICATIONS

The present application claims the benefit of U.S. Provisional Application No. 61/873,540, entitled "ANTENNA RELATED FEATURES OF A MOBILE PHONE OR COMPUTING DEVICE" filed Sep. 4, 2013, the content of which is incorporated herein by reference in its entirety for all purposes.

FIELD

The described embodiments relate generally to features of a mobile phone or computing device, and more particularly to antenna related features of a mobile phone or computing device.

BACKGROUND

The quest for production of smaller, lighter, and cheaper devices is ongoing. In this regard, by way of example, it may be desirable to produce components and layers of components for in computing devices that are relatively thin in order to provide benefits such as reduced material usage, reduced size, and reduced weight. However, the production of such components may present certain challenges.

For example, when a circuit board is manufactured to fit into a thin device, the number of electrical connections that can be configured to and from the circuit board may be limited by the compact design specifications for the device. Attempts to make the most of such thin geometries can result in signal leakage between components and loss of signal quality over certain connections. Moreover, by having limited configurations for connections within a device, grounding pathways may be limited creating even more of a risk for electrical shorts. Therefore, improving the arrangement of electrical connections within a device continues to be an ongoing challenge for device designers.

SUMMARY

This paper describes various embodiments that relate to antenna and grounding related features of a mobile phone or computing device. In one embodiment, an electrical device is set forth having an antenna circuit and a main logic board including a control feed and an antenna feed operatively coupled to the antenna circuit. The control feed is configured to communicate a control signal from the main logic board to the antenna circuit to modify an antenna signal exclusively at the antenna circuit. Additionally, the antenna feed can be configured to communicate a modified antenna signal to the main logic board according to the control signal. Moreover, the control feed and antenna feed can be physically separated between the antenna circuit and the main logic board in the electrical device.

In another embodiment, an electrical circuit is set forth having a circuit board, a screw extended from an aperture in the circuit board, and a conductive cantilever. The conductive cantilever can include a first end affixed to the circuit board by the screw, and a second end pressing down on an electrical contact on the circuit board. In this way the conductive cantilever provides a conductive pathway between the electrical contact and the screw.

In yet another embodiment, an electrical circuit is set forth having a first surface and a second surface, and a screw residing in an aperture of the electrical circuit. Additionally, the electrical circuit includes a first washer coupled to the first surface of the electrical circuit, the first washer including a first metal contact that abuts a first contact on the first surface of the electrical circuit and a second metal contact that is coupled to a common contact. The electrical circuit can also include a second washer coupled to the second surface of the electrical circuit, the second washer including a first metal contact that abuts both a second contact on the second surface of the electrical circuit and a second metal contact that is coupled to the common contact.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

Figure 1A:
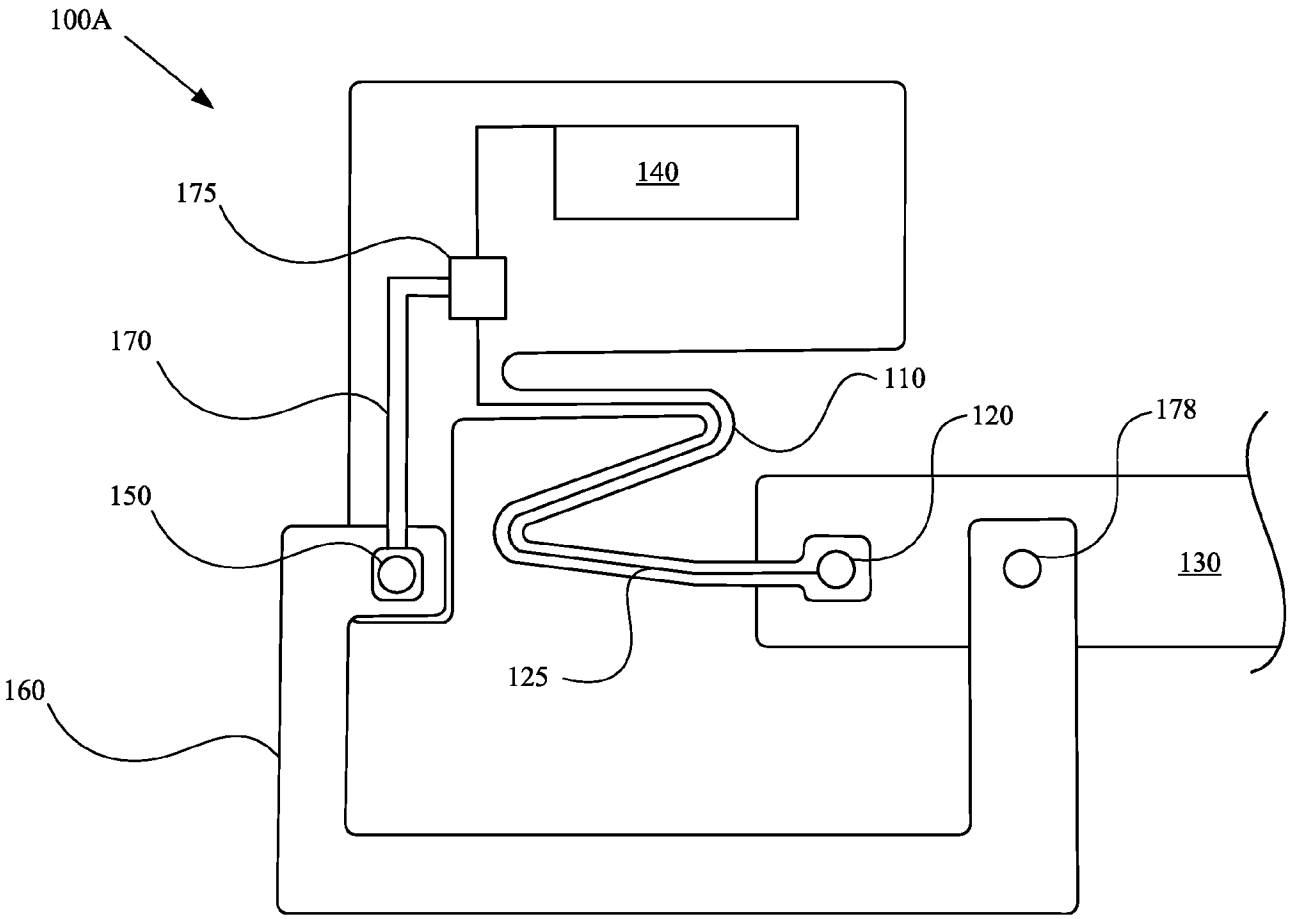
FIG. 1A illustrates a device, where wireless control and signal are fed.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

As portable devices become smaller, the need to make the most of limited space inside of the portable devices increases. One way to maximize space is to use a component inside a portable device for multiple purposes in order to avoid having to duplicate a component for separate use by the portable device. For example, flexible cables can be used for multiple purposes inside a portable device such as transferring both control signals and antenna signals (e.g., Wifi and Bluetooth signals). This feature is achieved by layering the flexible cable to have separate signals being sent over different layers. In some designs it is desirable to use a polyimide ("PI") layer to create a layer for carrying antenna signals because of its flexible properties and versatility. Additionally, a layer of liquid crystal polymer ("LCP"), a special type of plastic resin, can also be used as an antenna layer. LCP is more desirable than PI because it results in less loss; however, when incorporating LCP into an existing antenna design, the resulting antenna cable is not as flexible or versatile as the PI antenna layer. A solution to this deficiency is to use an LCP antenna that is separate from the flexible cable. By using a separate LCP antenna cable, the flexible cable can still be exploited for its flexible properties. Additionally, less LCP antenna cable would be required because the LCP layer would not be incorporated into the length of the flexible cable and can be designed to have a shorter antenna feed path within the portable device further reducing signal loss.

Additional adjustments can be made to improve signal loss within a portable device. In some portable devices, multiple wave lengths of signals are encoded and decoded across the portable device. For instance, signals can be broadcast between a circuit board and an antenna circuit. The signal can be filtered using components on the circuit board prior to sending the filtered signals to the antenna circuit. However, flexible circuit is sometimes used to transfer the filtered signal from the circuit board to the antenna circuit which can result in signal loss. To result this deficiency, filtering and other signal processing functions can be performed at the antenna circuit. This is accomplished in part by using a coaxial cable to transfer the unfiltered signal between the circuit board and the antenna circuit. Upon receipt of the signal by the antenna circuit, the antenna circuit can filter, switch, and target various signals received from the broad signal traveling through the coaxial cable. This results in less loss to signal integrity for the final broadcast signal in part because the filtering of the signal is occurring on the antenna circuit, rather than the circuit board which is less proximate to the broadcast location.

Other aspects of managing signal integrity of portable devices can be more challenging as portable devices become thinner. For example, limitations on the thickness of a device can be mean less available less mechanical strength for the various connections and components because the dimensions of structural components such as screws would be minimal. One very important connection to portable devices is grounding for signal paths. Often times a metal plate can be designated as a ground, and any screws holding the plate in place can be configured as a connection point for ground cables. Additionally, a signal cable can be grounded to the metal plate using a conductive adhesive to ensure the signal cable stays in place on the metal plate. Unfortunately, conductive adhesives may not provide the mechanical strength needed to provide an optimal path to ground. To resolve this issue, it may be necessary to apply further force to the signal cable, ground plate, and conductive adhesive. One way to apply additional force while staying within the desired dimensions of the portable device is to use a small cantilever between a screw and the cable. The cantilever can have a beam that is anchored at one end by a screw residing in the metal ground plate. On the other end of the beam, the mechanical load on the beam is pressed firmly on to the signal cable, conductive adhesive, and ground. In this way, not only is the signal cable reinforced by the cantilever, but also a double ground is created through the conductive adhesive to the ground plate, and through the cantilever to the screw connected to the ground plate.

Screws of portable devices can also be optimized in other ways to provide better connections in a portable device. For example, given the thickness constraints of many portable devices, connections between electrical components and an antenna feed can be limited to either a top or bottom side of a circuit board of the portable device. This configuration can be troublesome when an antenna is proximate to electrical connections on a circuit board but only a limited number of convenient paths are available to the antenna from the electrical components. For instance, a screw attached to a metal chassis of a portable device can be a path to an antenna for a portion of a circuit board. Space around the screw can be cluttered with antenna feeds to the screw leaving limited space for other electrical components needing either a path to the antenna. To resolve this issue, a double or stacked feed path can be used to provide multiple antenna feeds through a single screw. Specifically, a screw can be placed through a circuit board into an antenna of a portable device to provide a path to the antenna. A dimpled washer can be attached to the screw below the circuit board to provide a path to the antenna at the bottom of the circuit board. On the top of the circuit board, layers of metal and plastic can be formed in stacks to provide numerous antenna feed paths up the length of the screw. The layers of plastic separate the layers of metal so that there is not interference between antenna feeds. In this way, space within the portable device is optimized by consolidating antenna feeds.

Antennas can also be optimized in the way that they are grounded. When grounding an antenna it is important to consider how the impedance affects the signal traveling through the ground connection. In portable device, most of the signals traveling through the antennas are high frequency and thus can be affected by the impedance of the ground connection. To provide a better path to ground for the antenna, a short pin connection can be used. The short pin should be designed as thin and long as possible, giving the short pin a low capacitance and high inductance. However, such short pins can brittle and susceptible to damage from external forces. To resolve these deficiencies, short pins can be reinforced through insert molding. In this way, a layer of plastic is formed around the bends and folds of the short pin to ensure the short pin is not affected by external forces FIG. 1A shows an embodiment of a device 100A, where wireless control and signal are fed separately. In general, device 100A is a generic device that can be used with any suitable wireless technology within a wide range of wavelengths, but, as an example, device 100A can be used with Wifi and/or Bluetooth technology. Flexible cables, or also referred to as flexible circuits, of device 100A can be made of layers of plastic and metal. For example, flexible cables can be made of polyimide ("PI") to send various control signals and act as an antenna feed because PI is flexible and therefore more versatile. Additionally, flexible cables can be made of a liquid crystal polymer ("LCP"), which is a special type of plastic resin that results in lower loss as compared to using PI. Unfortunately, using LCP in the flexible cable results in a flexible cable that does not bend as well as a flexible cable made from PI. As a result, using multiple layers of flexible cable to send both control signals and antenna signals when incorporating LCP into flexible cables causes the flexible cables to become over constrained and prevents other connections from being closer to the flexible cable carrier antenna signals.

To resolve this issue, the antenna feed and control signals can be separated onto individual flexible cables. In device 100A, flexible cable 110 is used to send antenna signals and flexible cable 160 is used to control signals. Flexible cable 110 is made from LCP and carries antenna feed 125, while flexible cable 160 is made from PI and carries control signals. As illustrated in FIG. 1A, flexible cable 110 is designed as a curved service loop in order create an antenna feed 125 from a single coaxial connector 120 on main logic board ("MLB") 130 to antenna 140. The service loop can be arranged in a zigzag pattern, or in a configuration such that a portion of the output from the control chip 175 moves toward and away from the MLB 130, before ultimately being received by the MLB 130. Flexible cable 110 and 160 can be of different lengths such that flexible cable 160 is longer than flexible cable 110. Flexible cable 160 can provide wireless controls signals between a board connector 178 of the MLB 130 and a board to board connector 150, through a control line 170, and ultimately to control chip 175. Also at control chip 175, the antenna feed 125 is connected between the coaxial connector 120 on the MLB 130 allowing the control signal from flexible cable 160 (or also referred to as a control feed) to be combined with antenna feed 125. The control signals from MLB 130 can include commands to filter, modify, switch, limit, or otherwise change any antenna signal received at antenna 140, before the antenna signal is sent to the MLB 130. By separating the flexible cable 160 and flexible cable 110 prior to combining the control signal and antenna feed 125, less LCP material is used to send signals between the MLB 130 to the control chip 175 and antenna 140. This saves the expense of incorporating more LCP material into flexible cable 160 and provides a better and more reliable signal path for antenna feed 125.

Other configurations for separating control signals and antenna feeds are within the scope of this disclosure. For example, in one embodiment the service loop incorporated into flexible cable 110 illustrated in FIG. 1A is not necessary in other embodiments. Additionally, more than one connection can be made at board to board connector 150 besides flexible cable 160. Moreover, control chip 175 can be replaced with other suitable components for optimizing, analyzing, and distributing various signals which the control chip 175 receives. Other signals besides Wifi, Bluetooth, or other wireless signals that can be received by an antenna are also considered within the scope of the embodiments set forth herein.

Figure 1B:
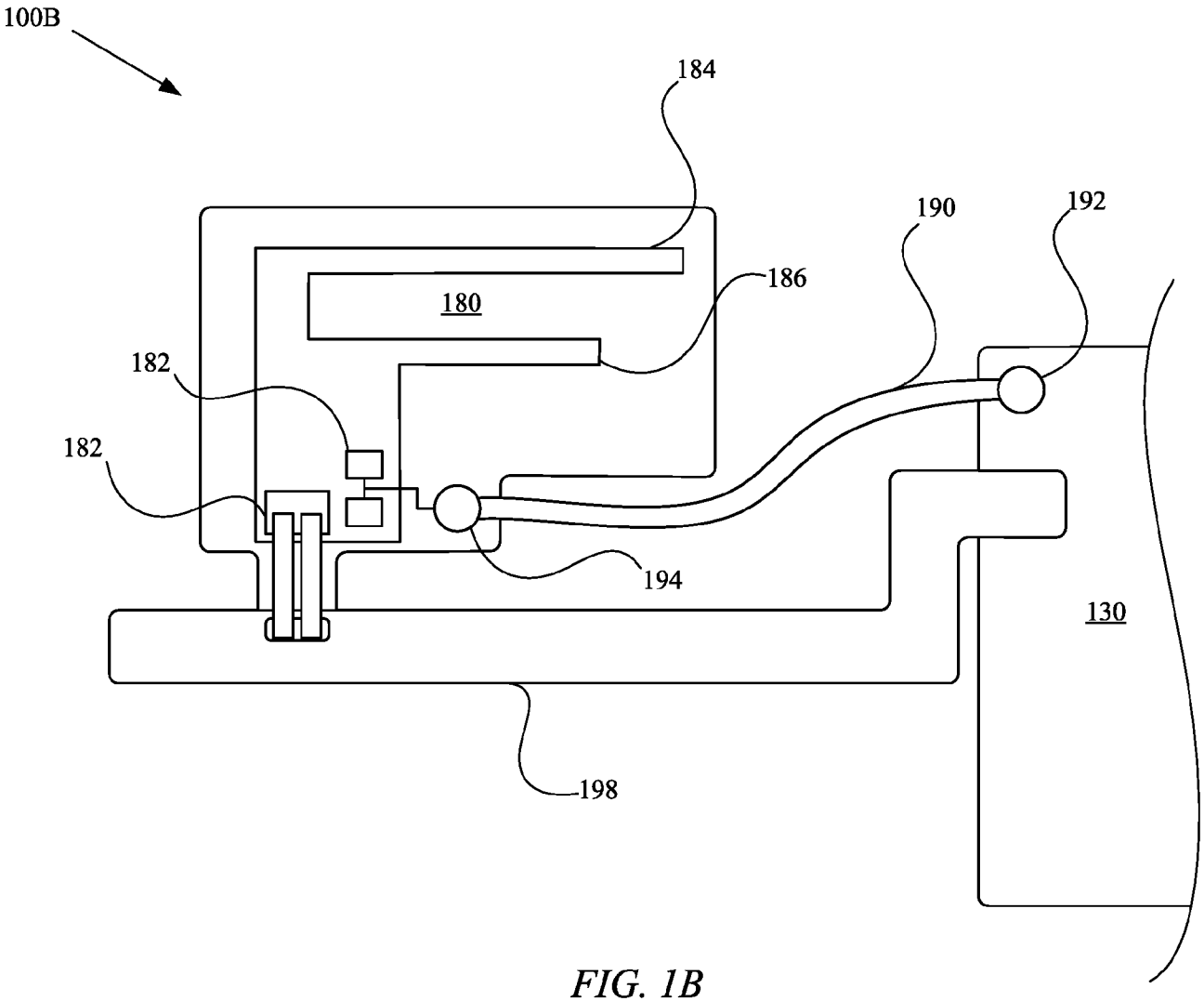
FIG. 1B illustrates a device, where active switching and processing of differing trace lengths are performed on an antenna flex.

FIG. 1B illustrates an embodiment of a device 100B, where active switching and processing of differing trace lengths are performed on an antenna circuit 180 (e.g., a flexible antenna circuit) so that antenna performance can be optimized for multiple wireless technologies covering a wide range of wavelengths. In device 100B, a flexible circuit 198 connecting main logic board ("MLB") 130 to active circuit components 182 on an antenna circuit 180 is used to send control signals from MLB 130 to antenna circuit 180, instead of over coaxial cable 190. Active circuit components 182 on antenna circuit 180 can then be used for signal processing on antenna circuit 180 instead of having the signal processing done on MLB 130. In general, antenna circuit 180 is a generic antenna flex that can be used with any suitable wireless technology within a wide range of wavelengths such as Wifi and/or Bluetooth technology. In some embodiments, the signal processing can include active switching, filtering, targeting, encrypting, decrypting, etc. One of the advantages of using device 100B is that having the active circuit components 182 directly on the antenna circuit 180 provides for varying lengths of conductive traces (e.g., 184 and 186) on antenna circuit180 suitable for sending, receiving, transmit, or otherwise communicating wireless signals of different wavelengths. In some embodiments, the conductive traces 184 and 186 are metal traces (e.g., copper).

The antenna circuit 180, can be connected to the main logic board (MLB) 130 via a coaxial cable 190 that can be connected between board connector 192 and board connector 194. The coaxial cable 190 can include a protective shielding layer to preserve signal integrity of the antenna signal. The reason for using coaxial cable 190 is because a coaxial cable can have the lowest loss for getting signal from MLB 130 to antenna circuit 180, thereby maximizing signal integrity. In situations where no control signal is sent via flexible circuit 198, any signal switching and filtering has to be performed on the MLB side. Unfortunately, performing the signal switching and filtering on the MLB side means the signal will have to travel longer distances before reaching the eventual broadcast point on antenna circuit 180. Therefore, depending solely on a coaxial connection between the MLB and the antenna flex is inefficient. To overcome this inefficiency, FIG. 1B sends control signals from the MLB to the antenna circuit separate from the coaxial cable 190. Using flexible circuit 198, or an already existing flexible circuit, control signals can be sent through to the antenna circuit 180 to the active circuit components 182, more proximate to where signal broadcasting is taking place. In this way, a shorter length of unshielded conductive trace can be used. Furthermore, live switching on the antenna flex allows for sending and receiving the transmission signals to different lengths of conductive trace (e.g., 184 and 186).

In device 100B, the switching and the filtering are now performed in the antenna flex instead of in the MLB. In one embodiment, an antenna circuit 180 might have only one active circuit component that is doing filtering. In another embodiment, an antenna circuit 180 can have one or more active circuit components that are: (1) switching signals on and off, (2) performing various filtering functions, and (3) targeting different wavelengths for specific applications.

In summary, FIG. 1B the actual routing and processing of the transmission signal is unique because FIG. 1B discloses a device that allows for active switching, filtering, and other processing on the actual antenna circuit, as opposed to the MLB. The antenna structure is unique because the antenna flex can include conductive traces of differing lengths, which are in turn associated with antenna signals of differing wavelengths. When used together, these two features provide for two main advantages. One advantage is that, by doing the active switching, filtering, and other processing locally on the antenna circuit, signal integrity is drastically improved. Other advantages are the ability of device 100B to physically switch on and off different trace lengths on the antenna circuit 180. This, in turn, allows for the targeted use of signals with different wavelengths, because physical trace length determines the wavelength of the signal. In other words, the physical switching of different trace lengths (e.g., conductive trace 184 and conductive trace 186) on the antenna circuit allows for the device to basically select specific trace length to target for specific parts (i.e., specific wavelengths) of the broadcast spectrum that the device wishes to operate in.

Figure 2A:
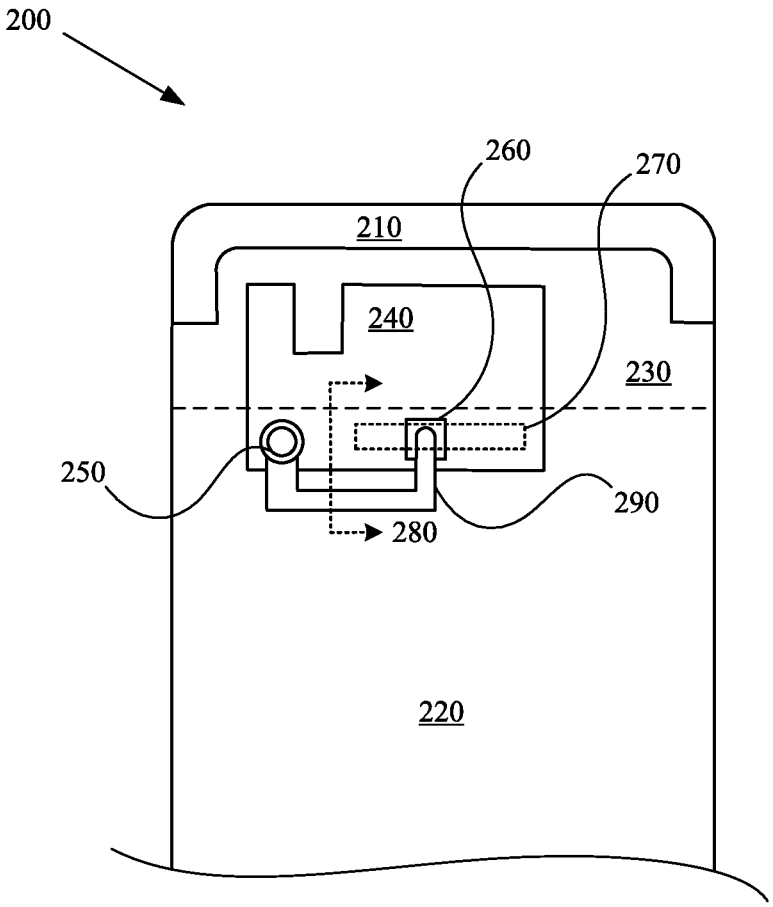
FIGS. 2A-2B illustrate a device with a cantilever arm affixed to a ground screw to provide double grounding.

FIG. 2A illustrates a double grounding configuration. Device 200 can be a portable electronic device, or any other suitable electronic device having a grounding connection. The device 200 has a U-shaped metal structure 210 that is used as an antenna for connecting wirelessly to other devices. Gap 230 is a plastic portion of the device 200 where other electronic components can be connected as a path to metal structure 220 which can act as a grounding plate. Flexible cable 240 is located in gap 230 and joined to the metal structure 220 at both the screw 250 and the conductive adhesive 290 which provides a ground for both the flexible cable 240 and an antenna contact 260. Screw 250 provides an excellent source to ground because the screw itself can be conductive while also clamping together conductive parts (e.g., the metal structure 220 and the flexible cable 240). However, the number of screw points available in a device is limited, since many devices have a shallow form factor. Because of a thickness constraint (e.g., a z-constraint) for the device 200 past line 280, reinforcement for the connection of antenna contact 260 and conductive adhesive 270 to ground is limited. For example, underneath a portable device display, which will contribute to device thickness and further reduce the z-constraint, the z-constraint is even more severe and even fewer locations can be available for a screw point. To resolve this deficiency while abiding by the thickness constraint past line 280, a cantilever 290 is placed between the screw 250 and the antenna contact 260.

Figure 2B:
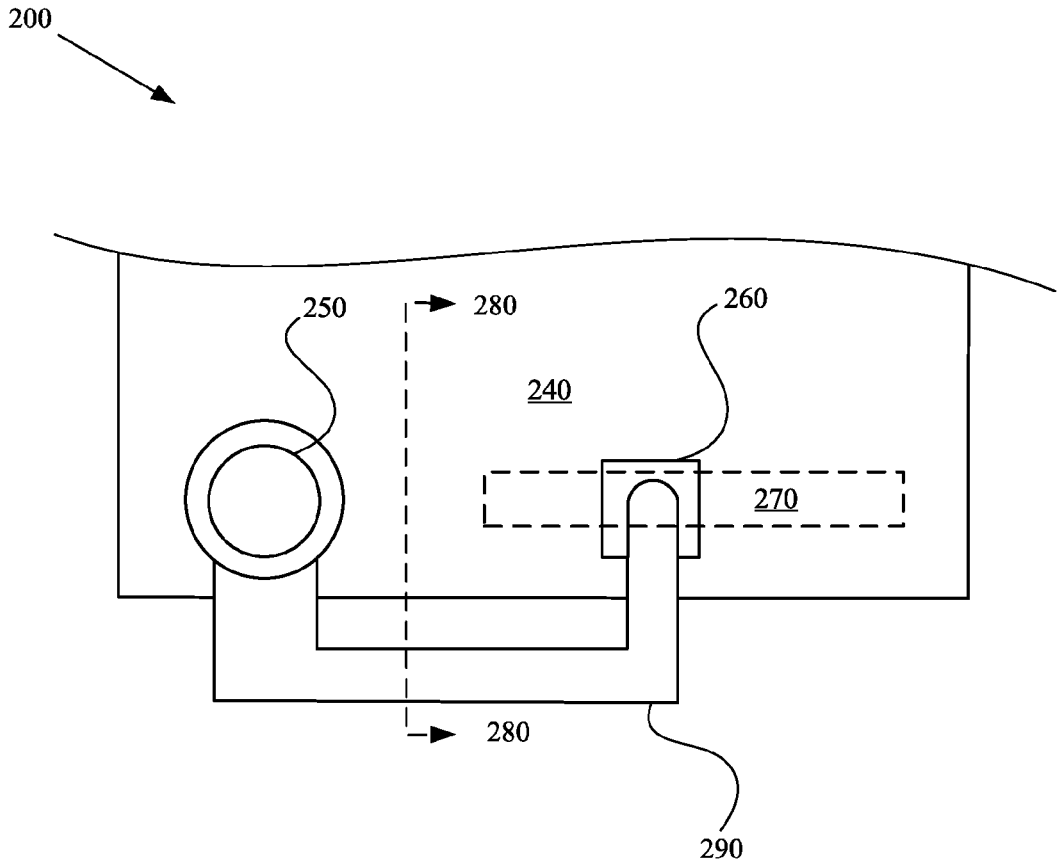

FIG. 2B illustrates a closer view of the cantilever 290. Antenna contact 260 requires an optimal path to ground and therefore should be reinforced as much as possible, especially when the path to ground is in part created by conductive adhesive 270. For an optimal ground path, conductive adhesive 270 needs to be pressed hard against the metal structure 220. If there were no thickness constraint past line 280, another screw 250 could be placed closer to the antenna contact 260. However, there are no additional screw points available in the area around antenna contact 260. Without a screw point, the ground contact formed with conductive adhesive 270 may not be reinforced adequately.

Cantilever 290 is affixed by screw 250 to further reinforce antenna contact 260 to ground. This results in a double ground configuration. A first ground connection is made by direct ground path from screw 250 to antenna contact 260, and a second ground connection is made between the antenna contact 260 and the conductive adhesive 270. This configuration is desirable because the cantilever 290 acts as a spring contact from screw 250 to transfer mechanical force from screw 250 through cantilever 290 and onto conductive adhesive 270. With the cantilever 290 pressing down the conductive adhesive 270, there is also additional grounding is available on the bottom side of the flexible cable 240 on the sides of antenna contact 260. In summary, the cantilever 290 performs double duty as a spring contact and a path to ground in areas of portable devices having a z-constraint (e.g., limited thickness available).

Figure 3A:
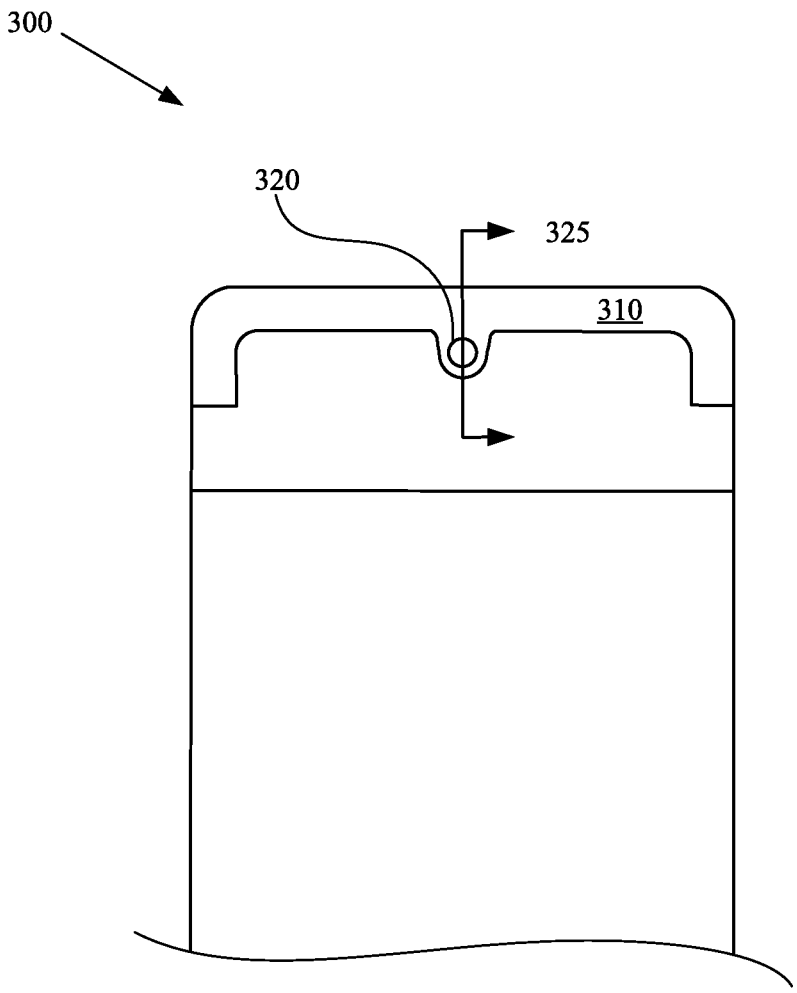
FIGS. 3A-3B illustrate a device that can provide a double feed for an antenna using a single screw.

FIG. 3A shows a device 300 with a double feed for antenna through a single screw in screw hole 320. A U-shaped metal band 310 acts as an antenna feed point through screw hole 320. The screw hole 320 provides a suitable antenna feed because the screw ensures a secure connection between the screw and metal band 310. The screwed down antenna feed is also ideal for manufacturing reasons because a screw can be easily implemented in a manufacturing setting. A cross-sectional view of the screwed down antenna feed is shown in FIG. 3B and the line of cross-section 325 is illustrated in FIG. 3A.

Figure 3B:
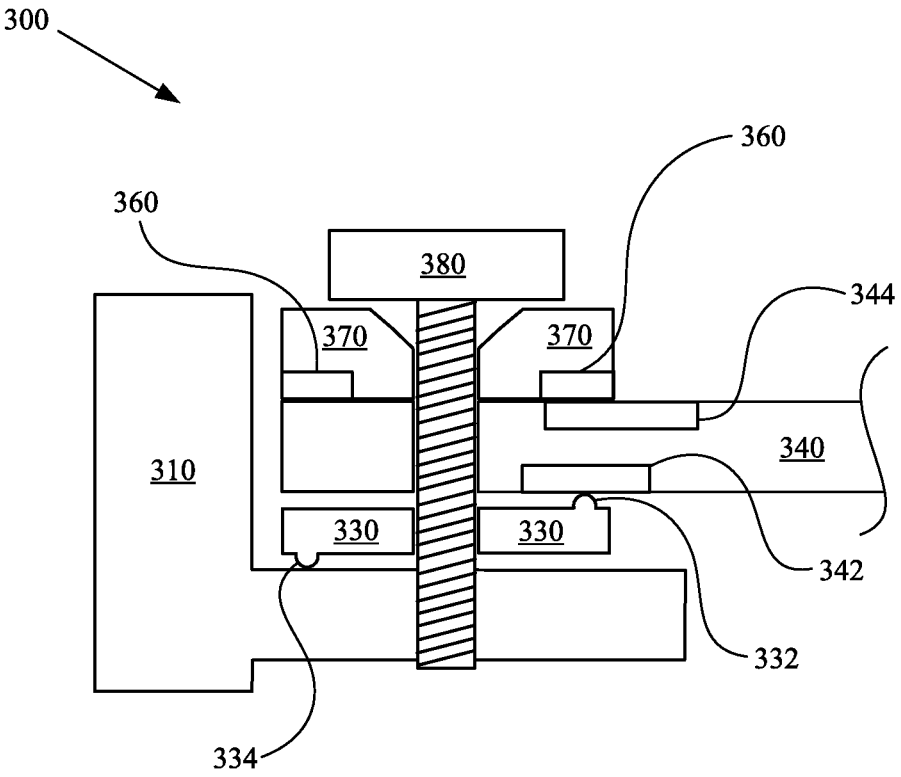
Figure 4A:
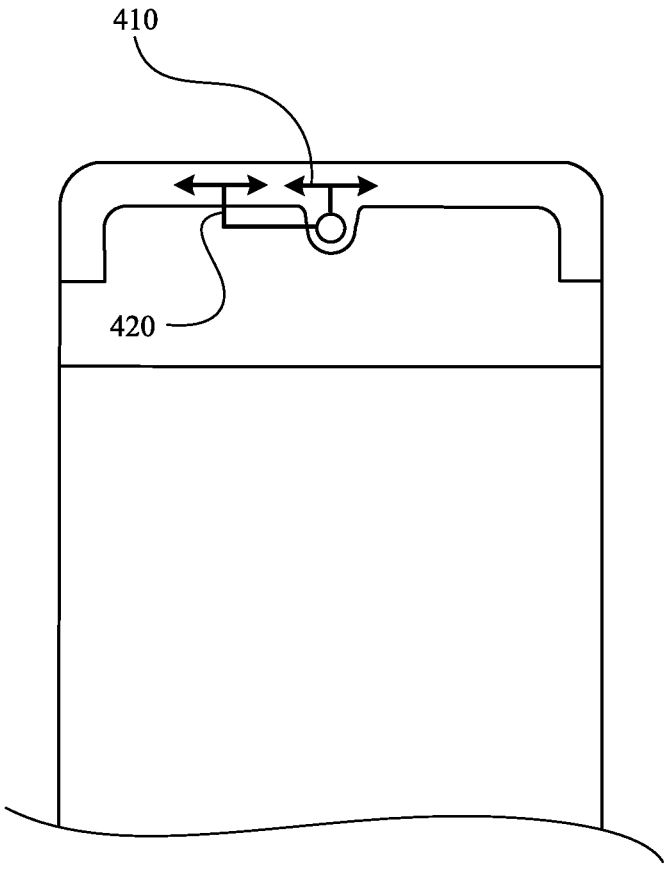
FIGS. 4A-4B illustrate the different electrical paths for the two antenna feeds shown in FIG. 3.
Figure 4B:
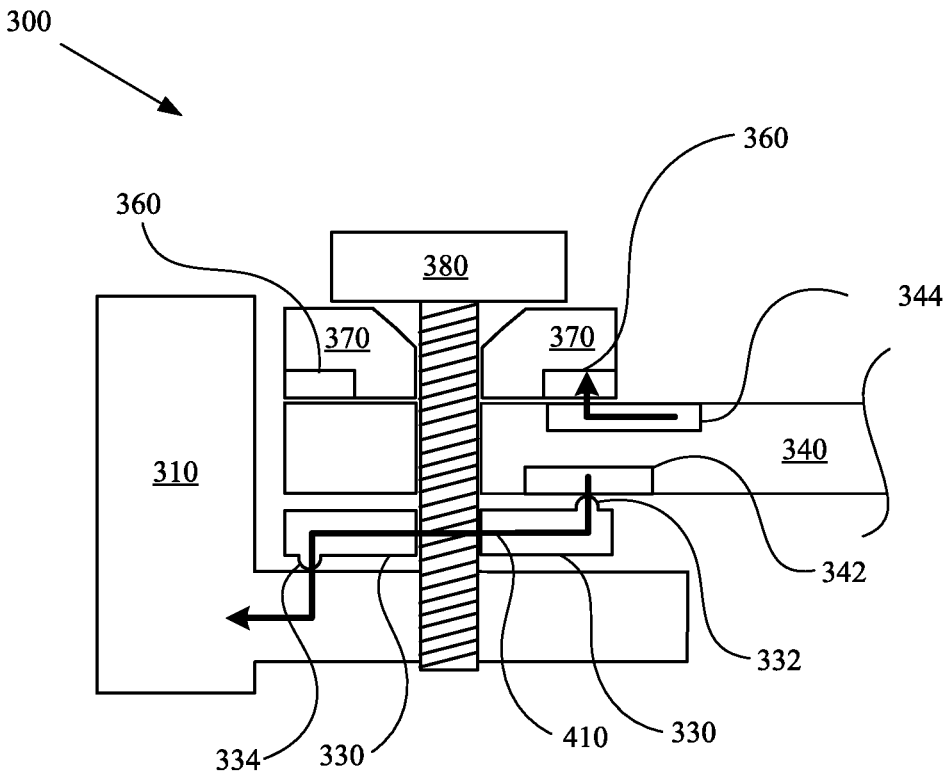

The cross-sectional view FIG. 3B of a device 300 shows a single screw as a double antenna feed. The term "double" refers to an antenna feed to be created from two locations, specifically, a top conductive region 344 of a main logic board (MLB) 340 and a bottom conductive region 342. To facilitate the double antenna feed, device 300 includes a washer 330 with a first dimple 332 in contact with the bottom conductive region 342 and a second dimple 334 in contact with the U-shaped metal band 310 (i.e. the antenna). The net result is that a first antenna feed path 410 (as shown in FIG. 4A) is created from the first dimple 332 through second dimple 334 and finally to the U-shaped metal band 310. In some embodiments, the dimples can be tuning dimples, which create specific points of contact that can be used to tune the structure.

A second antenna feed path 420 (shown in FIG. 4A) can be incorporated into device 300 as further illustrated in FIG. 3B. The second antenna feed path 420 is configured at a top region of the main logic board 340. The second antenna feed path 420 comprises a top conductive region 344 that abuts metal washer 360 establishing a conductive path. The metal washer 360 can include an arm that extends to the U-shaped metal band 310 establishing the second antenna feed path 420. In this way, both the first antenna feed path 410 and second antenna feed path 420 connect to the U-shaped metal band 310, but do so through different paths without contacting each other. In some embodiments, the first antenna feed path 410 and second antenna feed path 420 are be isolated from each other until they get into the U-shaped metal band 310. To accomplish this, metal washer 360 is spaced out widely from the screw hole and plastic 370 is grown around metal washer 360 so that metal washer 360 is isolated from screw 380. FIG. 3A illustrates plastic 370 isolating metal washer 360 from screw 380. In some embodiments, the gap between metal washer 360 and screw 380 is provided for reducing capacitive coupling. In this way, by spacing the metal washer 360 out widely from the screw hole using plastic 370, the overlap between the metal washer 360 and screw 380 is minimized and the capacitive coupling is reduced.

Figure 5:
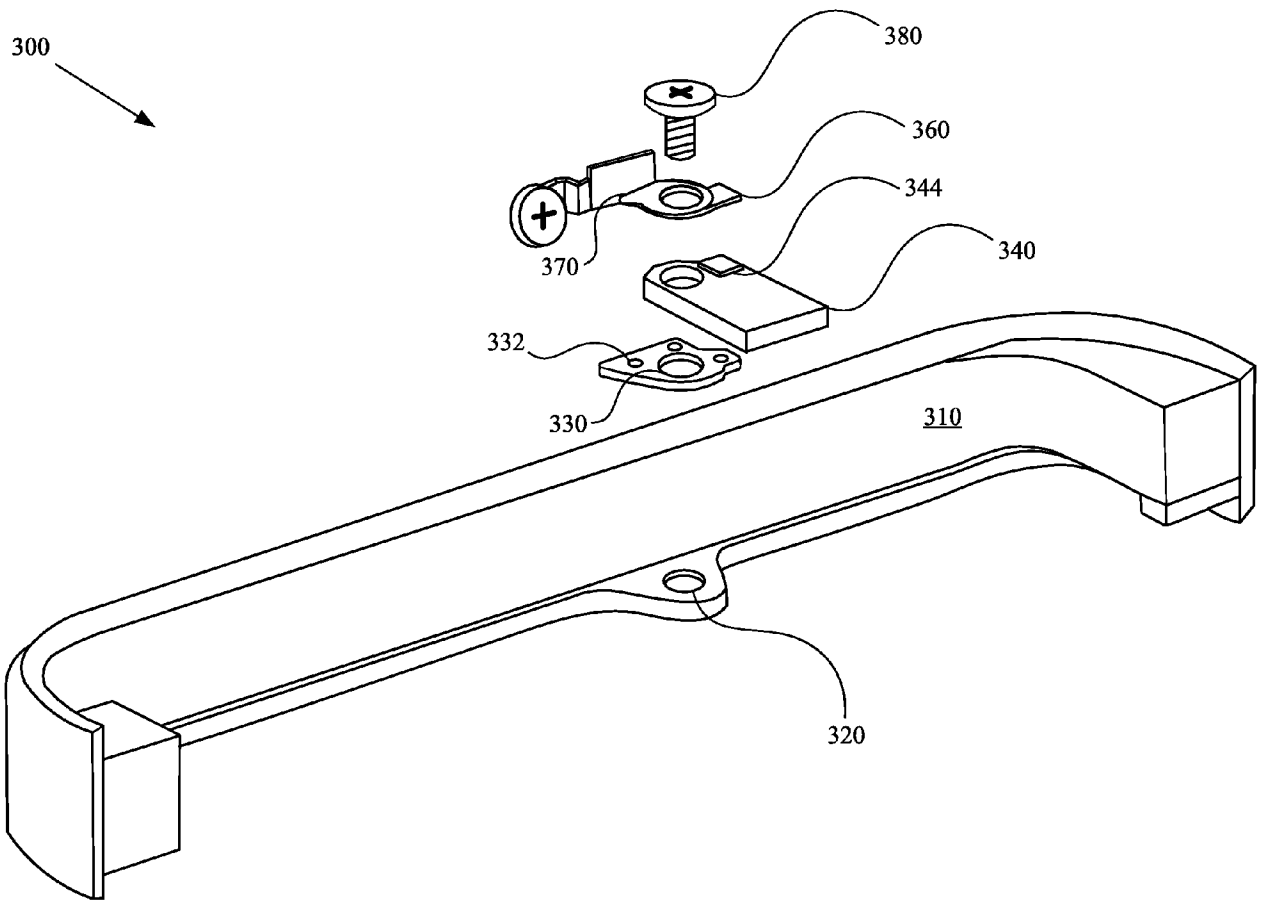
FIG. 5 illustrates an exploded view of the FIG. 3 device that can provide double feed for antenna an using a single screw.

FIG. 5 provides an exploded view of device 300 illustrated in FIG. 3. Screw 380 provides the support for mounting a double antenna feed for the U-shaped metal band 310 (i.e. the antenna). The double antenna feed is created by inserting screw 380 into the plastic 370 and metal washer 360. The metal washer 360 has a lip that sticks out to abut the top conductive region 344 of the MLB 340. In this way, the second antenna feed path 420 is created when screw 380 is received by the U-shaped metal band 310 abutting the lip of metal washer 360. The first antenna feed path 410 is created when the bottom conductive region 342 (not shown in FIG. 5) under the MLB 340 abuts three dimples 332. The metal washer 360 also has dimples on the bottom of the metal washer 360 that abut the U-shaped metal band 310. In this way, the first antenna path is created between the U-shaped metal band 310, metal washer 360, and the MLB 340.

In summary, FIGS. 3A-5 show a device with one screw and a layer or stack of electrical connections that create a double antenna feed path. The key feature of device 300 is that the top side and bottom side of MLB 340 is clamped with a single screw with an isolated washer on one side and an isolated (i.e., metal with plastic isolation), or non-isolated, washer on the other side creating two feeds off of one screw. In one embodiment, an isolated washer can also be used on the bottom so that the metal on the bottom washer touches the MLB 340 but not the screw 380.

Figure 6:
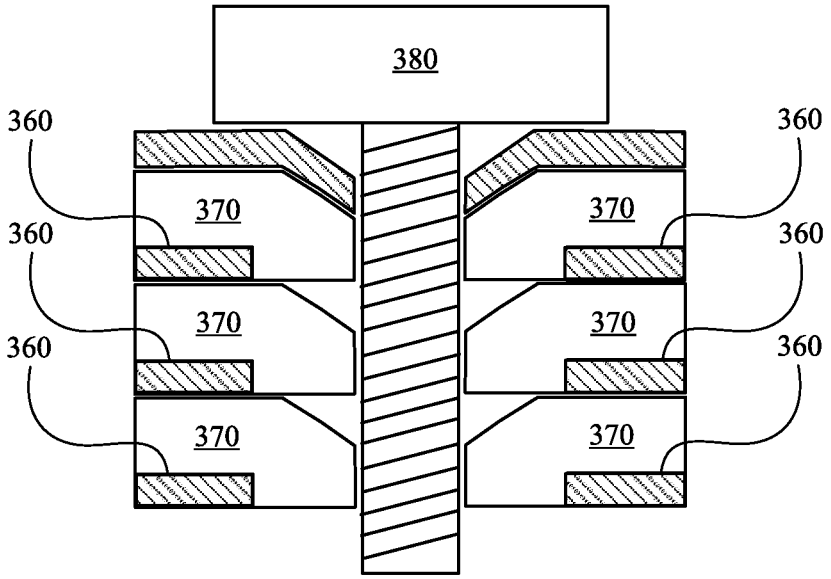
FIG. 6 illustrates a device that can provide triple feed for an antenna using a single screw.

In one embodiment, an antenna feed with more than two feeds can be achieved, as illustrated in FIG. 6. In FIG. 6, isolated washers are stacked together in succession. Any suitable number of stacks of washers can be created in this way depending on the configuration desired for a particular portable device. In some embodiments, multiple isolated washers can be stacked together in succession with just a single screw. Moreover, the direction of antenna feeds coming off the washers can extend in different directions and include a variety of dimple arrangements as further illustrated in FIGS. 7A-7C.

Figure 7A:
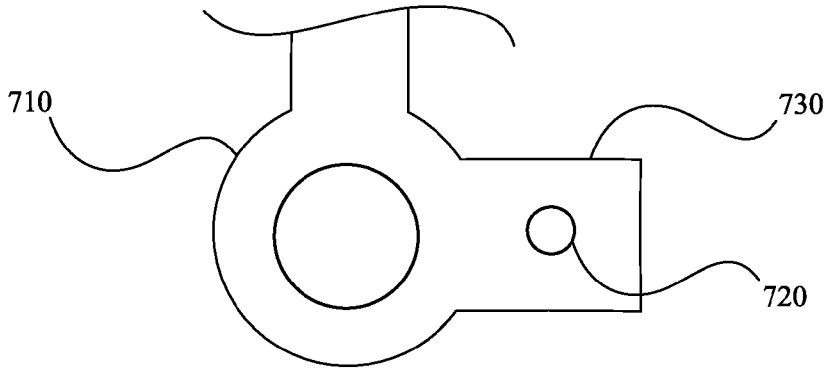
FIGS. 7A-7C illustrate different washer shapes and dimples used to establish single or double feeds.
Figure 7B:
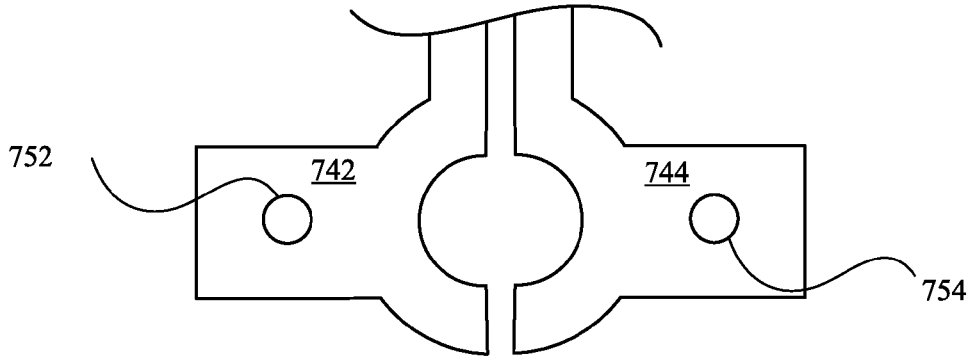
Figure 7C:
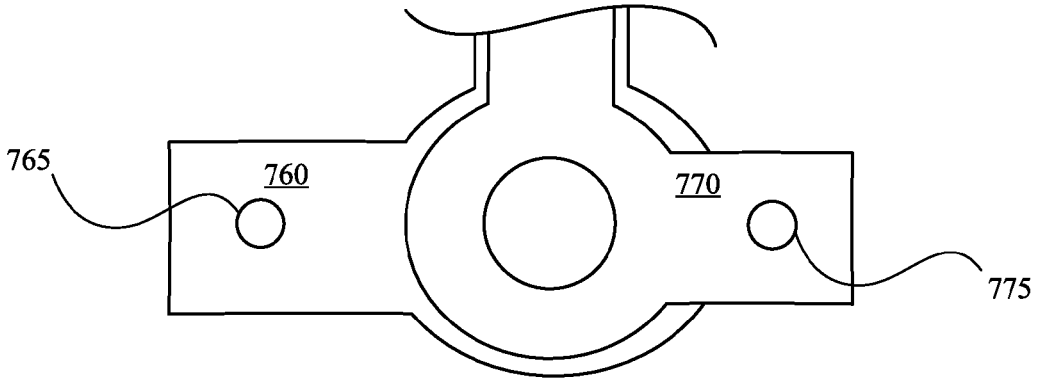

FIGS. 7A-7C show how different washer shapes and dimples can be used to establish single or double antenna feeds in a variety of directions. For example, FIG. 7A shows the metal portion of a washer 710 belonging to a stack clamped together by a single screw. An antenna feed to a circuit board from washer 710 can be established through a dimple 720 that is manufactured onto a lip 730 sticking out from the circular part of the washer. If washer 710 is an isolated washer, then it would be embedded in plastic. If washer 710 is a non-isolated washer, then there would be no plastic embedding. FIG. 7B illustrates an embodiment a washer can be broken up into two non-contacting washers 742 and 744 to accommodate for two separate feeds. Here, an antenna feed from a circuit board to washer 742 can be established through dimple 752, while a second antenna feed from the circuit board to washer 744 can be established through dimple 754. FIG. 7C shows that two whole washers 770 and 760 can be configured for antenna feeds in two different directions. Dimple 765 corresponds to washer 760, while dimple 775 corresponds to washer 770, and for isolation, plastic is disposed between the two washers. The cross-sectional view of FIG. 7C would resemble the FIG. 6 with antenna feeds extending in opposite directions. In other embodiments the antenna feeds can extend in more than two different directions. In some embodiments, some antenna feeds can extend in the same direction while other antenna feeds on the same stack extend in differing directions.

Figure 8A:
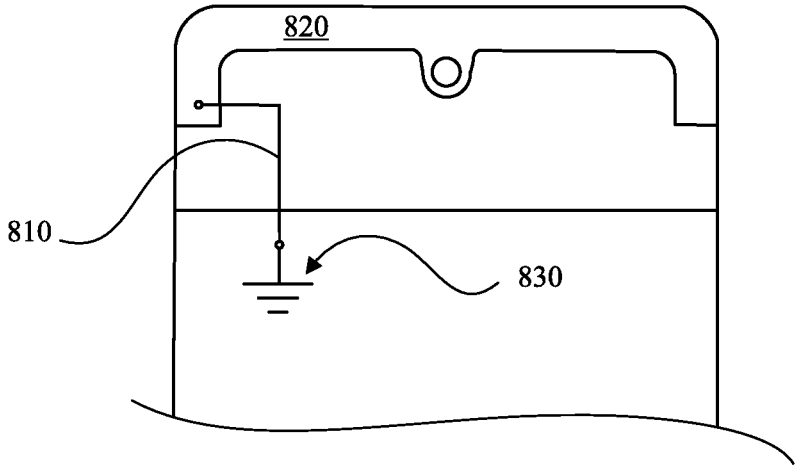
FIG. 8A illustrates schematically a short connection from an antenna to the chassis ground.
Figure 8B:
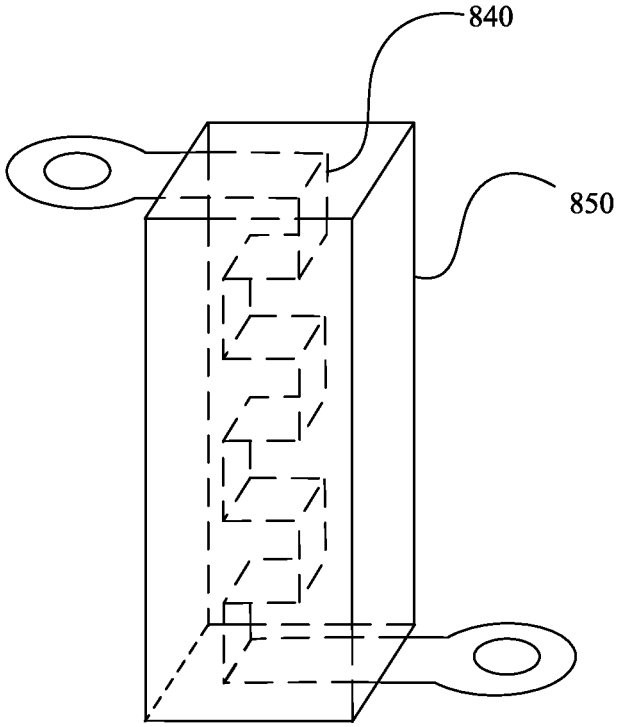
FIG. 8B illustrates an insert molded short pin for supporting thinner metal and maintaining metal geometry.

FIG. 8A shows a short pin connection 810 from antenna 820 to the chassis ground 830. One of the goals for a short pin is to have low capacitance and high inductance, which usually means making the short pin as skinny and long as possible, but without the overlapping the metal to avoid any capacitive coupling. In the drive to make short pin as long and as skinny as possible, one approach is to make the short pin out of very thin metal and zigzag the metal, as shown in FIG. 8B. Because this short pin is super thin, it is very easy to damage when screwed onto a device or disturbed by external forces (e.g., dropping the portable device for which the short pin is contained). Solutions for protecting this short pin are set forth herein.

In one embodiment, insert molding is used to embed a short pin in plastic. Once the short pin is embedded in plastic, as illustrated in FIG. 8B, the short pin 840 is essentially restricted in movement by the molding 850. However, the plastic around the short pin may damage the short pin during the insert molding process making the process somewhat less desirable. However, in some embodiments the insert molding can include using posts to support the short pin 840 during molding and optimizing for low pressure molding. In this way, the short pin structure is prevented from being mangled during the molding process. In another embodiment, clamps are used to hold the short pin structure in place during the molding process.

Figure 8C:
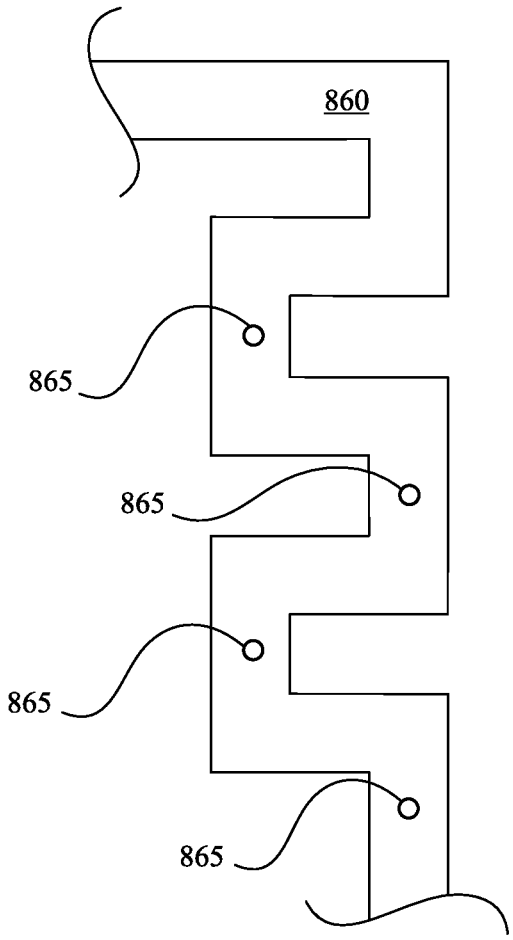
FIG. 8C illustrates using a planar metal pattern as a short pin that allows for easier insert molding.

FIG. 8C illustrates an alternate embodiment for stabilizing the short pin 860 during insert molding. In order to hold the short pin structure in place during insert molding the short pin 860 is configured in a two dimensional planar configuration. A planar metal pattern can hold in place during the insert molding process better than a three dimensional configuration without substantially altering the purpose of the short pin. The short pin 860 is then held in place during the molding process by posts 865. During the insert molding process, plastic is sprayed around short pin 860 and posts 865 to create a three dimensional, insert molded short pin 860.

Figure 8D:
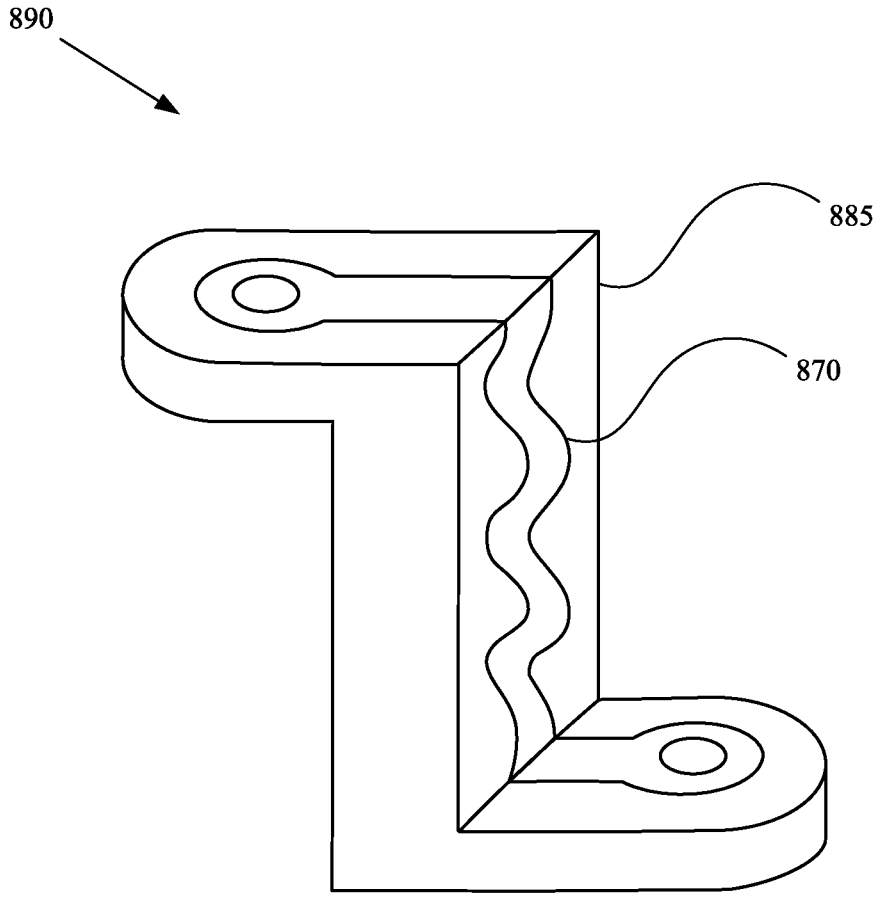
FIG. 8D illustrates using laser directed sintering ("LDS") plastic to form a short pin.
Figure 8E:
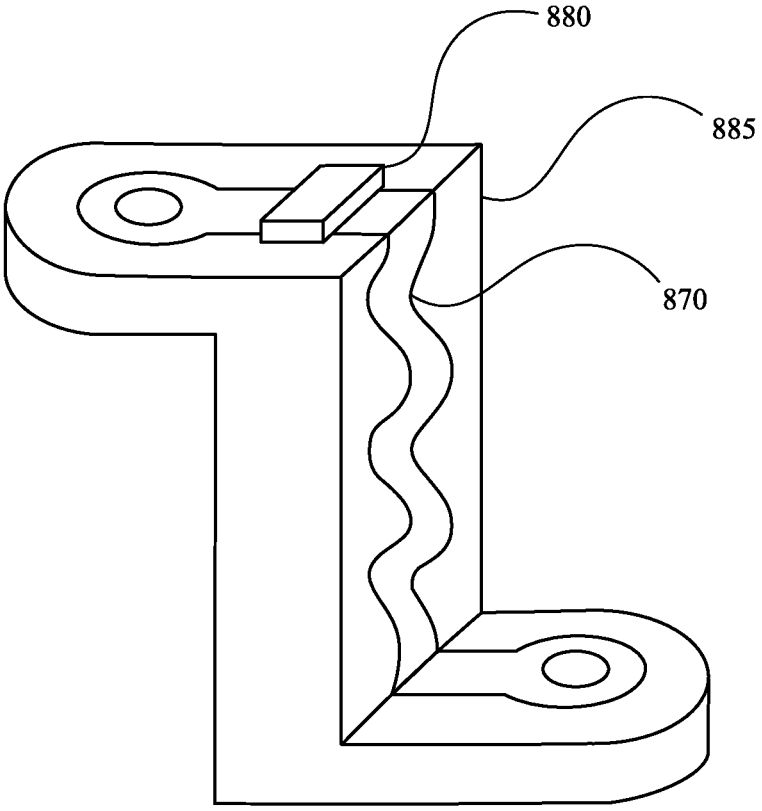
FIG. 8E illustrates a tuning component soldered onto a short pin for additional tuning.

FIG. 8D shows yet another embodiment using a laser directed sintering ("LDS") plastic 885 to stabilize short pin 870 inside of an LDS short pin 890. The LDS plastic 885 can be any suitable plastic used during laser directed sintering. A portion of the LDS plastic 885 is removed out of the LDS plastic 885 creating a cavity shapes for the desired metal pattern using a laser. The laser changes the surface chemistry of the LDS plastic 885 allowing a metal to be received by the LDS plastic 885. The result of this process is an extremely thin metal (e.g., the short pin) incorporated into an LDS plastic 885. FIG. 8D shows one possible such design using LDS plastic 885 to create a short pin 870. Because a laser is used to mold the plastic, almost any suitable design and shape is possible. In some embodiments, a sticker or a coating can be applied to the LDS short pin 890 to protect the LDS short pin 890 from scratching. In one embodiment shown in FIG. 8E, a tuning component 880 can be soldered onto the short pin 870 to add additional tuning component 880 allows an inductor, resistor, or capacitor to be added for tuning the short pin by swapping it in and out. This is useful for engineering, but later in production a design can be locked in and the appropriate tuning component 880 kept on the short pin 870 as part of the design.

Figure 9A:
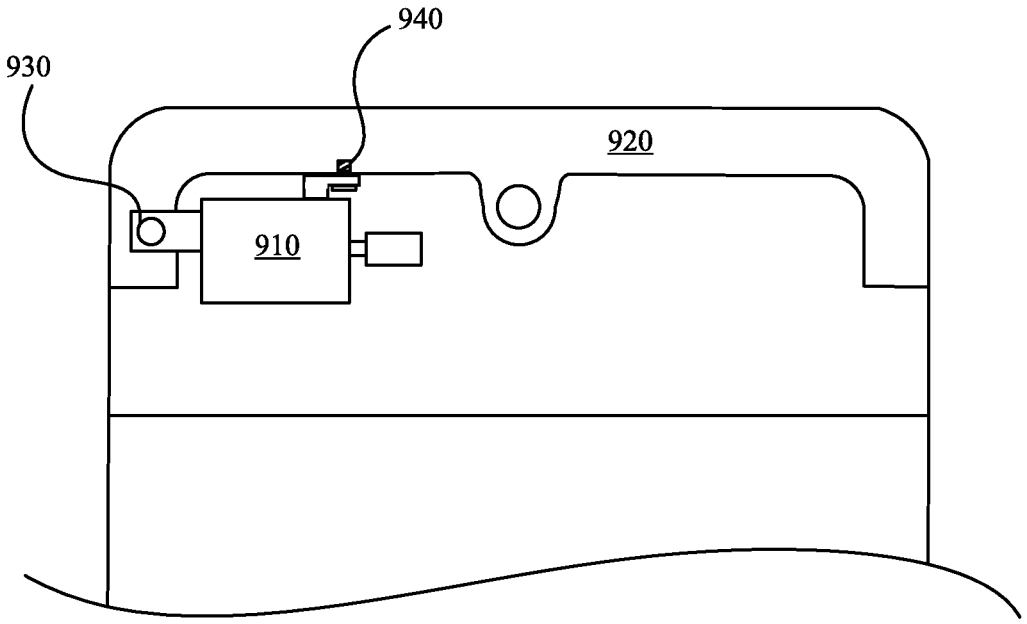
FIGS. 9A-9C illustrate an LDS short pin and a vibrator bracket sharing a common screw point.
Figure 9B:
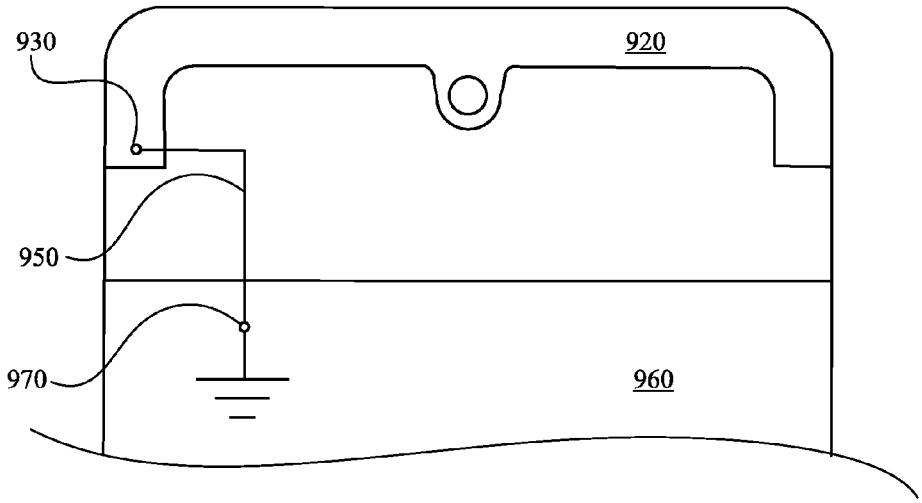
Figure 9C:
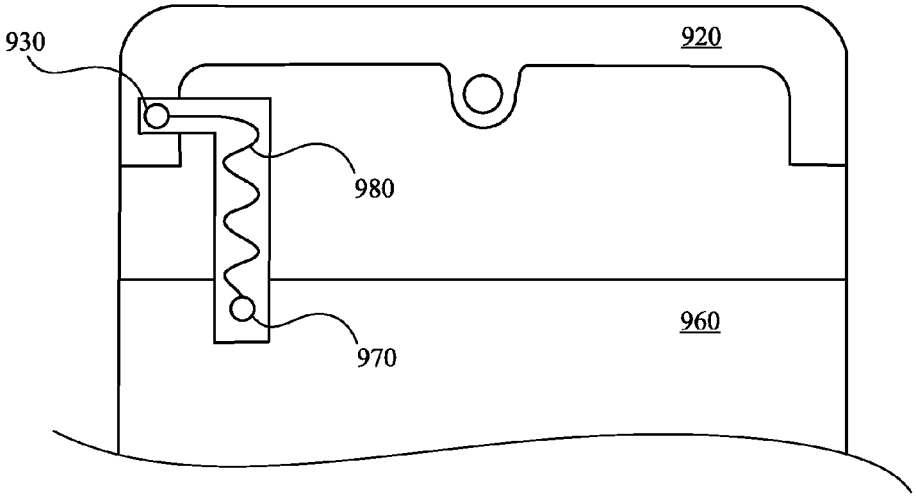

FIGS. 9A-9C illustrate an LDS short pin and a vibrator bracket can sharing a single screw. Using a single screw for multiple functions allows space reduction in shallow form factor devices and z-constrained device, where the number of screw points available is severely limited. Specifically, FIG. 9A shows a vibrator motor 910 with a welded-on metal bracket that connects to two screw points 930 and 940 of the U-shaped metal band 920. The screw points 930 and 940 can be orthogonal to each other, or in any other suitable arrangement for securing an optimal connection between the vibrator motor 910 and the U-shaped metal band 920. FIG. 9B shows a short connection 950 from U-shaped metal band 920 to chassis ground 960. The short connection 950 is connected to U-shaped metal band 920 via screw point 930 and chassis ground 960 via screw point 970. As illustrated in FIG. 9C, a short connection 950 can be implemented at screw point 930 using an LDS short pin 980. The LDS short pin 980 is connected to the U-shaped metal band 920 and chassis ground 960 via screw point 970. In order for the vibrator bracket and the LDS short pin 980 to share the screw at screw point 930, the metal vibrator bracket is first insert molded with LDS plastic, so that the bracket is now a plastic block with two metal arms sticking out that can be attached to screw points 930 and 940. This plastic block is also extended to screw point 970 with LDS plastic so that an LDS short pin can be formed on the plastic block. In this way, the vibrator bracket and LDS short pin are attached to all three screw points (i.e., 930, 940, 970).

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. An electrical device, comprising:

an antenna circuit configured for active switching and signal processing thereon;

a main logic board separate from the antenna circuit, wherein the main logic board is configured to receive an antenna signal from the antenna circuit and send a control signal to the antenna circuit to control the active switching and signal processing thereon;

a control feed coupling the antenna circuit to the main logic board, wherein the control feed is configured to communicate the control signal from the main logic board to the antenna circuit to modify the antenna signal exclusively at the antenna circuit; and an antenna feed coupling the antenna circuit to the main logic board, wherein the antenna feed is configured to communicate the antenna signal to the main logic board from the antenna circuit, and wherein the control feed and the antenna feed are physically separated from each other and follow separate paths from the antenna circuit to the main logic board.

2. The electrical device of claim 1, wherein the control feed includes a flexible circuit and the antenna feed includes a coaxial cable.

3. The electrical device of claim 1, wherein the antenna circuit is configured to communicate Wifi and Bluetooth signals.

4. The electrical device of claim 1, wherein the antenna circuit includes a plurality of conductive traces having different lengths for communicating different wavelengths of wireless signals.

5. The electrical device of claim 4, wherein the antenna circuit includes active components configured to receive the control signal from the main logic board and switch between the conductive traces according to the control signal.

6. The electrical device of claim 1, wherein the antenna feed comprises a liquid crystal polymer.

7. The electrical device of claim 1, wherein the control feed comprises polyimide.

8. A system, comprising:

an antenna circuit having an antenna comprising a plurality of conductive traces for communicating different wavelengths of wireless signals;

a main logic board configured to send control signals that control operation of the antenna circuit;

a control component coupled to the antenna circuit and the main logic board;

a control feed connecting the antenna circuit and the control component; and an antenna feed connecting the main logic board and the control component, wherein the antenna feed is physically separated from and follows a different path than the control feed from the control component to the main logic board, and wherein the system is configured to:

send control signals from the main logic board to the control component through the control feed, communicate an antenna signal at the plurality of conductive traces, and transmit the antenna signal from the antenna circuit to the main logic board through the antenna feed, exclusively according to the control signals.

9. The system of claim 8, wherein the control feed is longer than the antenna feed.

10. The system of claim 8, wherein the control component is configured to selectively communicate wireless signals by at least one of the conductive traces of the plurality of conductive traces based on the control signal.

11. The system of claim 8, wherein the antenna feed comprises a liquid crystal polymer.

12. The system of claim 8, wherein the control feed comprises polyimide.

13. The system of claim 8, wherein the antenna feed is a coaxial cable having a protective shielding layer to preserve signal integrity of the antenna signal.

14. The system of claim 8, further comprising a plurality of control components.

15. The system of claim 14, wherein the plurality of control components have a combined functionality to switch between conductive traces and filter the conductive traces.

16. A method for manufacturing an antenna circuit, the method comprising:

connecting the antenna circuit to a control component, the antenna circuit having an antenna comprising a plurality of conductive traces for communicating different wavelengths of wireless signals;

coupling the control component to a main logic board through a control feed; and connecting the antenna circuit to the main logic board through an antenna feed, wherein the antenna feed is physically separated from and follows a different path than the control feed from the antenna circuit to the main logic board.

17. The method of claim 16, further comprising:

configuring the main logic board to send control signals between the main logic board and the control component through the control feed.

18. The method of claim 16, further comprising:

configuring the antenna circuit to communicate antenna signals at the plurality of conductive traces, and transmit antenna signals between the control component and the main logic board through the antenna feed, exclusively according to a control signal from the main logic board.

19. The method of claim 16, wherein the antenna feed is a coaxial cable and the control feed is a flexible circuit.

20. The method of claim 16, wherein the plurality of conductive traces are configured to transmit Wifi and Bluetooth signals.

* * * * *